US009139024B2

(12) United States Patent
Driggers et al.

(10) Patent No.: US 9,139,024 B2
(45) Date of Patent: Sep. 22, 2015

(54) SENSOR POSITIONING SYSTEM

(71) Applicant: HEWLETT-PACKARD DEVELOPMENT COMPANY, L.P., Houston, TX (US)

(72) Inventors: Matt G. Driggers, Vancouver, WA (US); Vern Elliot Myers, Vancouver, WA (US); Raymond C. Sherman, Vancouver, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 11 days.

(21) Appl. No.: 13/755,951

(22) Filed: Jan. 31, 2013

(65) Prior Publication Data

US 2014/0210886 A1 Jul. 31, 2014

(51) Int. Cl.

| | |
|---|---|
| ***B41J 11/00*** | (2006.01) |
| ***B41J 29/02*** | (2006.01) |
| ***B41J 29/38*** | (2006.01) |

(52) U.S. Cl.

CPC ..... *B41J 11/0095* (2013.01); *B41J 29/02* (2013.01); *B41J 29/38* (2013.01)

(58) Field of Classification Search

USPC ..... 399/74; 250/239

See application file for complete search history.

(56) References Cited

U.S. PATENT DOCUMENTS

| | | | | |
|---|---|---|---|---|
| 5,172,987 | A | 12/1992 | Stellmach et al. | |
| 5,192,141 | A | 3/1993 | Chung et al. | |
| 5,856,833 | A | 1/1999 | Elgee et al. | |
| 6,241,334 | B1 | 6/2001 | Haselby | |
| 6,464,414 | B1 | 10/2002 | Washnock | |
| 6,485,124 | B1 | 11/2002 | King et al. | |
| 6,561,615 | B2 * | 5/2003 | Okawa et al. | 347/19 |
| 6,568,782 | B1 | 5/2003 | Haselby | |
| 7,122,800 | B2 | 10/2006 | Barry et al. | |
| 7,145,780 | B2 | 12/2006 | Malone et al. | |
| 7,198,265 | B2 * | 4/2007 | Chelvayohan et al. | 271/110 |
| 7,224,493 | B2 * | 5/2007 | Chelvayohan et al. | 358/405 |
| 7,866,788 | B2 | 1/2011 | Jorba et al. | |
| 7,869,047 | B2 * | 1/2011 | Henderson | 356/445 |
| 8,203,749 | B2 | 6/2012 | Vilar et al. | |
| 2010/0110435 | A1 * | 5/2010 | Onishi | 356/402 |
| 2012/0120143 | A1 | 5/2012 | Amit et al. | |

* cited by examiner

*Primary Examiner* — Stephen Meier
*Assistant Examiner* — Renee I Wilson
(74) *Attorney, Agent, or Firm* — Dicke, Billig & Czaja, PLLC

(57) ABSTRACT

A sensor positioning system including a moveable sensor holder having a following surface, the sensor holder configured to hold an optical sensor at a selected distance from the following surface, a biasing system configured to bias the following surface against a surface of a sheet of print medium, and a drive system configured to move the sensor holder across the sheet of print medium with the following surface biased against and sliding on the surface of the sheet of print medium to maintain the optical sensor at substantially the selected distance from the surface of the sheet of print medium.

20 Claims, 10 Drawing Sheets

SENSOR POSITIONING SYSTEM

BACKGROUND

Inkjet printers employ printheads that eject drops of ink from a plurality of orifices or nozzles, typically arranged in one or more columns or arrays, onto a page or sheet of print medium. A scanning type printhead employs one or more printhead dies mounted on a carriage. The carriage is moved or scanned across a scan axis relative to a sheet of print medium while a controlled sequence of individual drops of ink are ejected from the nozzles to so that the dies work together to collectively form a band or "swath" of an image, such as a character, symbol, or other graphic, on the print medium. Between scans, the print medium is incrementally advanced relative to the scan axis so that the image may be incrementally printed.

In contrast, a wide array printhead employs a plurality of stationary printhead dies mounted on a support or bar, the plurality of stationary dies being arranged relative to one another so as to span a page of print medium. Such a printhead is sometimes referred to a print bar. Each of the plurality of the printhead dies is controlled to eject individual drops of ink from the nozzles, with the drops of ink from the plurality of stationary printhead dies together forming an image on the print medium. The print medium is continually advanced so that an image can be completed in a single pass.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Figure 1:
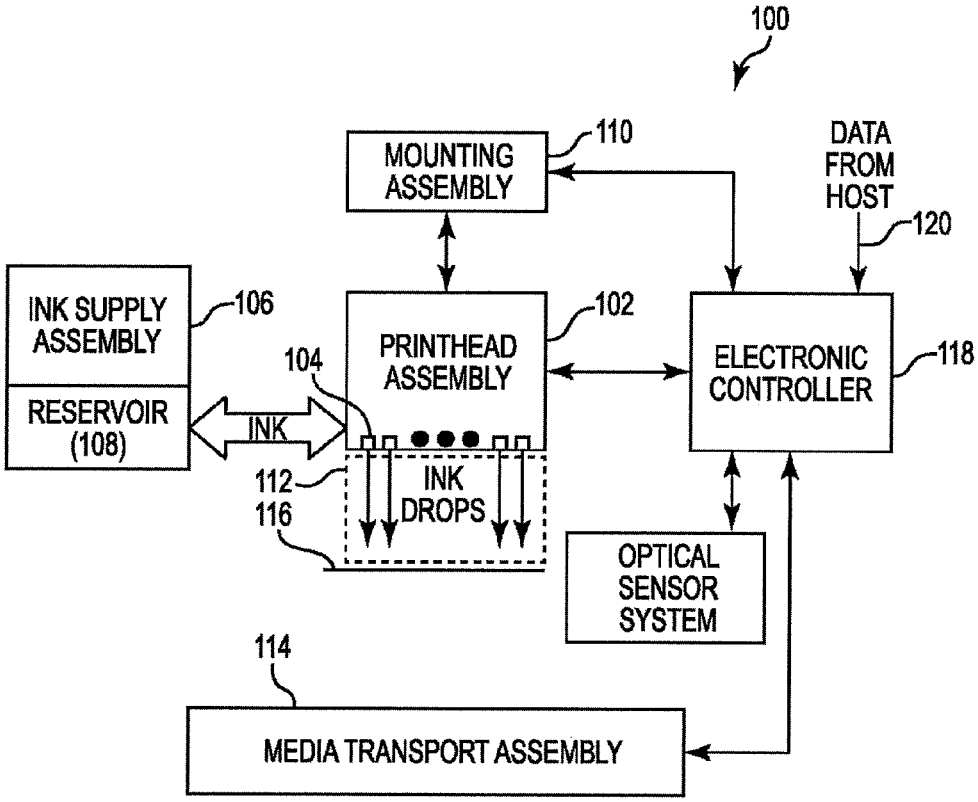
FIG. 1 is a block diagram illustrating an example of an inkjet printing system.

FIG. 1 is a block diagram illustrating one example of an inkjet printing system 100. Inkjet printing system 100 provides a fluid ejection system that includes a fluid ejection device, such as a printhead assembly 102. Inkjet printing system 100 also includes a fluid supply, such as an ink supply assembly 106, a mounting assembly 110, a medium transport assembly 114, an electronic controller 118, and an optical sensor assembly 130 which, according to one embodiment, measures an optical density of ink printed onto a surface of a print medium 116 by printhead assembly 102.

Variations in medium shape, for example, cockle (e.g., a wrinkled, puckered, or rough surface) and bow, and variations in mechanical tolerances of components of inkjet print system 100 can cause variations in the distance and relative angle of the an optical sensor to the surface of the print medium 116 at different locations across the surface of print medium 116, potentially resulting in inaccurate optical density measurements. According to examples described herein, optical sensor assembly 130 addresses this by employing a self-adjusting sensor positioning system that maintains an optical sensor at substantially a selected distance from the surface of the sheet of print medium 116 as the sensor is moved across the surface.

Printhead assembly 102 ejects drops of ink, including one or more colored inks, through a plurality of orifices or nozzles 104. While the following disclosure refers to the ejection of ink from printhead assembly 102, in other examples other liquids, fluids, or flowable materials may be ejected from printhead assembly 102. In one example, printhead assembly 102 directs drops of ink toward a medium, such as print medium 116, to print onto print medium 116. Typically, nozzles 104 are arranged in one or more columns or arrays such that properly sequenced ejection of ink from nozzles 104 causes characters, symbols, and/or other graphics or images to be printed upon print medium 116 as printhead assembly 102 and print medium 116 are moved relative to each other.

Print medium 116 includes paper, card stock, envelopes, labels, transparent film, cardboard, rigid panels, or other suitable medium. In one example, print medium 116 is a continuous form or continuous web print medium, such as a continuous roll of unprinted paper.

Ink supply assembly 106 supplies ink to printhead assembly 102 and includes a reservoir 108 for storing ink. As such, ink flows from reservoir 108 to printhead assembly 102. In one example, ink supply assembly 106 and printhead assembly 102 form a recirculating ink delivery system. As such, ink flows back to reservoir 108 from printhead assembly 102. In one example, printhead assembly 102 and ink supply assembly 106 are housed together in an inkjet or fluidjet cartridge or pen. A plurality of pens may be combined to form a print bar. In another example, ink supply assembly 106 is separate from printhead assembly 102 and supplies ink to printhead assembly 102 through an interface connection, such as a supply tube.

Mounting assembly 110 positions printhead assembly 102 relative to medium transport assembly 114, and medium transport assembly 114 positions print medium 116 relative to printhead assembly 102. As such, a print zone 112 within which printhead assembly 102 deposits ink drops is defined adjacent to nozzles 104 in an area between printhead assembly 102 and print medium 116. Print medium 116 is advanced through print zone 112 during printing by medium transport assembly 114.

Electronic controller 118 communicates with printhead assembly 102, mounting assembly 110, and medium transport assembly 114. Electronic controller 118 receives data 120 from a host system, such as a computer, and includes memory for temporarily storing data 120. Typically, data 120 is sent to inkjet printing system 100 along an electronic, infrared, optical, or other suitable information transfer path. Data 120 represents, for example, a document and/or file to be printed. As such, data 120 forms a print job for inkjet printing system 100 and includes one or more print job commands and/or command parameters.

In one example, electronic controller 118 provides control of printhead assembly 102 including timing control for ejection of ink drops from nozzles 104. As such, electronic controller 118 defines a pattern of ejected ink drops that form characters, symbols, and/or other graphics or images on print medium 116. Timing control and, therefore, the pattern of ejected ink drops, is determined by the print job commands and/or command parameters. In one example, logic and drive circuitry forming a portion of electronic controller 118 is located on printhead assembly 102. In another example, logic and drive circuitry forming a portion of electronic controller 118 is located off printhead assembly 102.

In one example, printhead assembly 102 is a scanning type printhead assembly with one or more printhead dies each having a plurality of orifices or nozzles through which ink drops are ejected. Mounting assembly 110 moves printhead assembly 102 relative to medium transport assembly 114 and print medium 116 during printing of a swath on print medium 116.

In another example, printhead assembly 102 is a non-scanning, wide-array type printhead assembly having a plurality of printhead dies being arranged relative to one another so as to span the width of a page of print medium. Mounting assembly 110 fixes printhead assembly 102 at a prescribed position relative to medium transport assembly 114 during printing of a swath on print medium 116 to thereby form a stationary print bar as medium transport assembly 114 advances print medium 116 past the prescribed position.

Optical density, as commonly used in the printing industry, is a measure of the extent of light reflection. When employing a scanning type printhead assembly, the optical density of the printed ink is usually not of great concern as the optical density across the nozzles of the single printhead die or across a single swath printed by multiple dies is typically substantially uniform.

However, when employing a wide array type printer having a plurality of laterally spaced apart printhead dies forming a print bar, there can be variance in the optical density of printed ink from printhead die to printhead die. Such variance in the optical density of printed ink between printhead dies of the print bar can cause undesirable and visually discernible non-uniformity in the darkness of a printed band or swath (e.g., text, image, characters, etc.) across the sheet of print medium.

According to one embodiment, optical sensor assembly 130 is configured to measure the optical density of printed ink orthogonal to individual swaths or across a sheet of print medium 116 (e.g. across a width of print medium 116 which is orthogonal to a direction of transport of print medium 116 along a medium transport path by medium transport assembly 114). According to one embodiment, wherein printhead assembly 102 is a non-scanning, wide-array type printhead assembly having a plurality of printhead dies being arranged relative to one another so as to span the width of the page of print medium 116, optical density measurements by optical sensor assembly 130 are provided to electronic controller 118 which adjusts the ejection of ink drops from nozzles 104 of the multiple printhead dies of printhead assembly 102 so that the plurality of printhead dies provides printed ink having a substantially uniform optical density.

One type of optical density sensor, commonly referred to as a reflective type density sensor, includes a light source (e.g., an LED) and an optical detector (e.g. a photodiode). Light from the light source incident on the surface of print medium 16 will be absorbed or reflected (and/or transmitted if the print medium 16 is transparent or translucent). Reflected light incident upon the optical detector generates a voltage and/or current proportional to its intensity which can be sensed and/or measured, with the amount of light incident upon the optical detector being proportional to the amount of light reflected from the surface of print medium 16. This measured reflected light is translated, such as by electronic controller 118 to an optical density of the printed ink on the surface of the sheet of print medium 116.

Because reflected light incident upon the optical detector is representative of the optical density of the printed ink, the distance from and the relative angle of the optical density sensor to the surface of the print medium is very important, as such parameters affect the amount of reflected light incident upon the optical detector and whether such light accurately represents the optical density of the corresponding printed ink being illuminated by the light source. Medium shape variations, for example, cockle (e.g., wrinkle, puckered, rough surface) and bow, and variations in mechanical tolerances of components of inkjet printing system 100 can cause variations in the distance and relative angle of the optical density sensor to the surface of print medium at different locations across the surface of print medium 116, potentially resulting in inaccurate optical density measurements.

According to embodiments described herein, optical sensor assembly 130 addresses this by employing a self-adjusting print medium sensor system including a moveable sensor holder having a following surface, the sensor holder configured to hold an optical density sensor at a selected distance from the following surface of the sensor holder. A biasing mechanism is configured to bias the following surface against a surface of the sheet of print medium 16, and a drive system is configured to move the sensor holder across the sheet of print medium with the following surface biased against and riding on the surface of the sheet of print medium so as to maintain the optical sensor at substantially the selected distance from the surface of the sheet of print medium.

Figure 2:
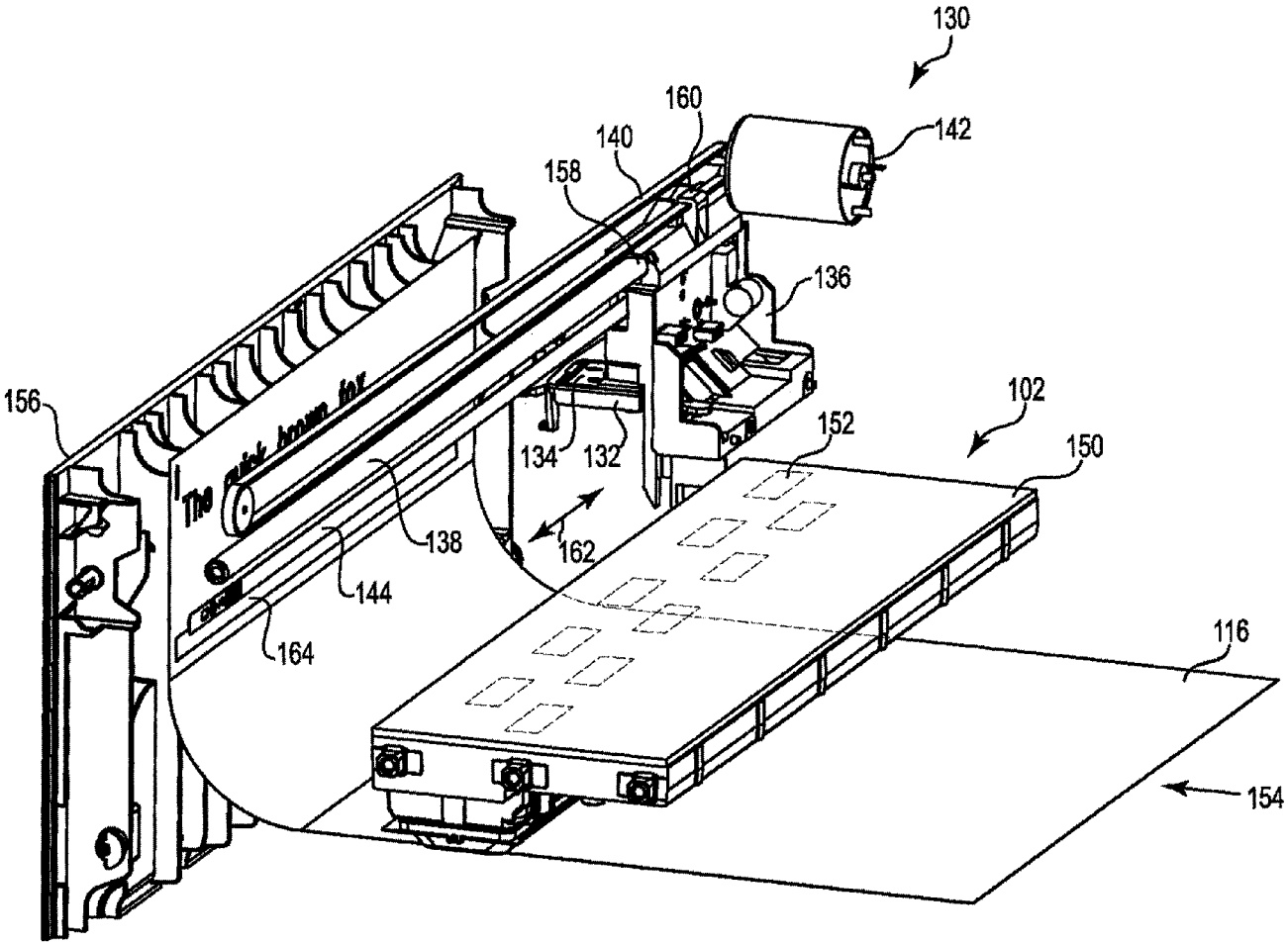
FIG. 2 is a perspective view illustrating one example of an optical sensor assembly.

FIG. 2 is a perspective view illustrating one example of an optical sensor assembly 130. Optical sensor assembly 130 includes a sensor holder 130, an optical sensor 134, a carriage 136, a carriage rod 138, a drive belt 140, a drive motor 142, and an encoder strip 144. Also generally illustrated are portions of printhead assembly 102, including a print bar assembly 150 including a plurality of printhead dies 152 disposed across a width of a sheet of print medium 116 in a direction which is orthogonal to a direction of travel 154 of print medium 116 along a medium transport path formed by medium transport assembly 114, including a panel 156 forming a medium guide. Note that printhead dies 152 are shown for illustrative purposes only, and do not accurately reflect the actual position of printhead dies 152 in print bar assembly 150. After being transported past printhead dies 152 of print bar 150, panel 156 directs print medium 116 upward past optical sensor assembly 130. It is noted that for ease of illustration, walls, frame and other support elements of of inkjet printing system 100 to which the above described components mounted/supported, such as carriage rod 140, drive motor 142, print bar 150, and panel 156, for example are not shown.

Optical sensor 134 is mounted to sensor holder 130, with sensor holder 130 being coupled to carriage 136. Carriage 136 is slideably mounted to carriage rod 138, as indicated at 158, and is fixedly coupled to endless drive belt 140 by a clamp mechanism 160. As controlled by electronic controller 118, drive motor 142, via belt 140, drives carriage 136 and, thus, sensor holder 130 and optical sensor 134 coupled there to, back and forth in a reciprocating fashion along carriage rod 138 in scanning directions 162 orthogonal to the direction of travel 156 of print medium 116. Test pattern 164 (represented by a rectangular box) is a test pattern printed on print medium 116 by printhead dies 152 of print bar 150 which, as will be described in greater detail below, is scanned by the optical sensor 134 of optical sensor assembly 130 to check, according to one embodiment, a uniformity of the optical density of printed ink between the multiple printhead dies 152 of print bar 150.

Figure 3:
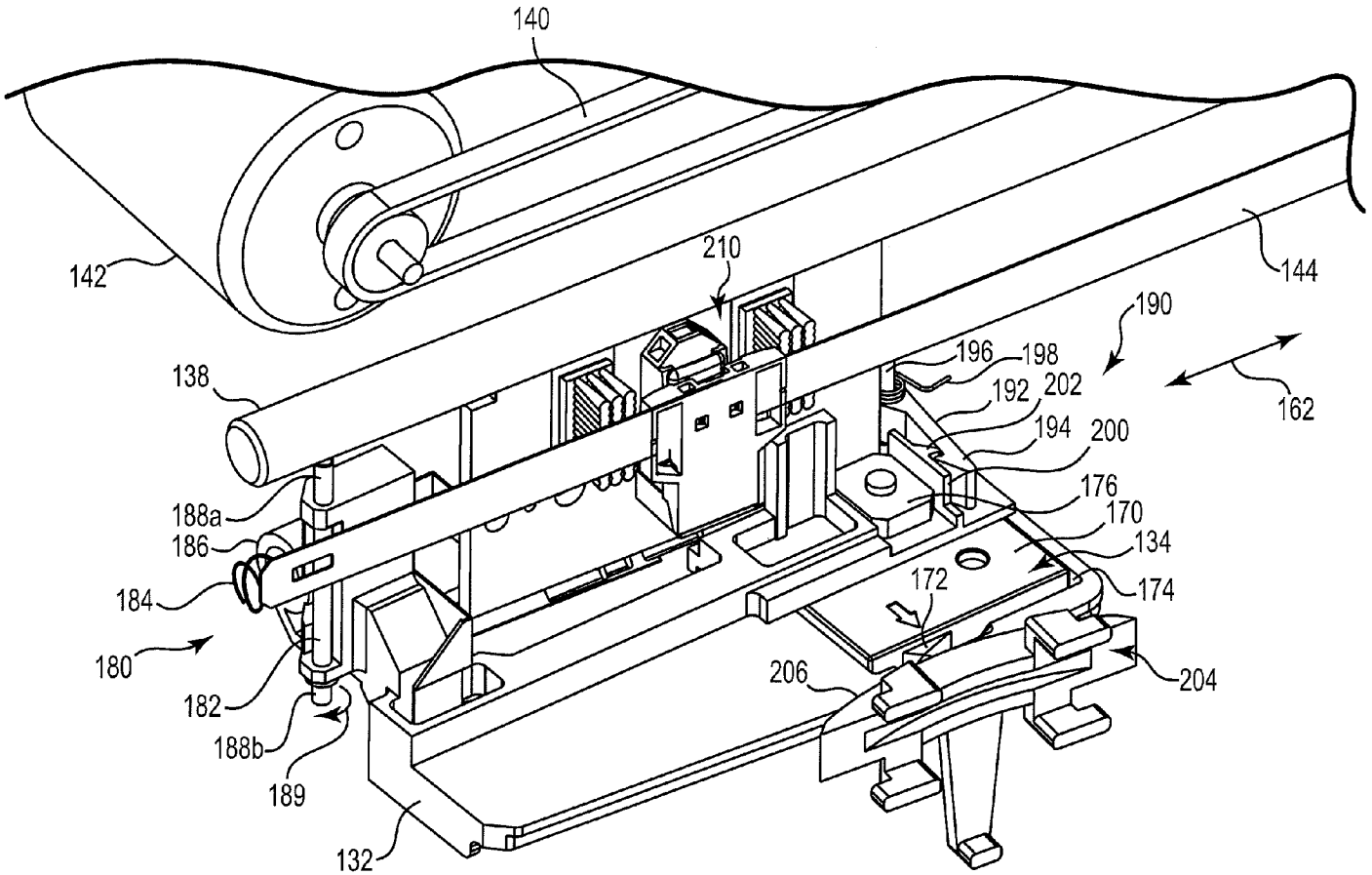
FIG. 3 is a perspective view illustrating one example of an optical sensor assembly.

FIG. 3 is a perspective view of optical sensor assembly 130 from an angle substantially to the reverse of that illustrated by FIG. 2 and which illustrates optical sensor assembly 130 in greater detail. Optical sensor 134 includes a housing 170 having an optical window 172. According to one embodiment, optical sensor 134 is a "reflective" type sensor including a light source, (e.g., an LED) and a light sensor (e.g., a photodiode) disposed within housing 170. The light source emits light through optical window 172 onto a target (e.g., the surface of print medium 116, such as printed test pattern 164 there on), and the light sensor measures the amount of reflected light received through optical window 172 (which is representative of the optical density of test pattern 164, for example). Optical sensor 134 is disposed within a mounting slot or channel 174 in sensor holder 132 and secured with a nut/bolt assembly 176, and which, as will be described in greater detail below, enables a position of optical sensor 134 to be adjusted within channel 174.

Optical sensor assembly 130 includes a biasing system 180 having a pivot, such as pivot pin 182, and a spring 184 having one end disposed within a spring retainer or shaft 186. Although not illustrated, ends 188*a*, 188*b* of pivot pin 182 and the opposing end of spring 184 are retained by carriage 136. As will be described in greater detail below, spring 184 provides a biasing force which provides a rotational force about pivot pin 182 in a clockwise direction (in FIG. 3) as illustrated by directional arrow 189.

Optical sensor assembly 130 additionally includes a deployment system 190 which, as will be described in greater detail below, is configured to move sensor holder 132 between a deployed position, where a portion of sensor holder 132 is in contact with a surface of print medium 116, and a retracted position, where sensor holder 132 is remote from the surface of print medium 116. According to one embodiment, deployment system 190 includes a latch arm 192 with a hook 194, with latch arm 192 being biased about a pivot pin 196 by a latch spring 198 such that hook 194 is biased against a jam 200 having a notch element 202. A hook release element 236 (see FIG. 7), which is mounted to a stationary element, such as a wall 228*b* (see FIG. 7) or housing component, for example, operates to rotate latch arm 194 about pivot pin 196 in a direction opposite that of latch spring 198 when contacted through movement of sensor holder 132 and carriage 136 along carriage rod 138. Deployment system 190 further includes a retraction ramp 204 having a curved surface 206, with retraction ramp 204 being supported by a stationary frame element (not illustrated). It is noted that other embodiments of deployment system 190 can involve other driven elements approaching carriage 136 close enough to push on a member of deployment system 190, or hook release element 236 being along the path of travel of carriage 136 and providing momentary contact to activate deployment system 190.

Optical sensor assembly 130, according to one embodiment, further includes a location sensor 210 configured to read location information encoded on encoder strip 144 which is representative of a location along the scanning axis of sensor holder 132 and, thus, optical sensor 134, as carriage 136 is moved along carriage rod 138. According to one embodiment, location sensor 210 provides location information read from encoder strip 144 to electronic controller 118 which determines the position of carriage 136 based on the location information. According to one embodiment, encoder strip 144 is an optical encoder strip which is encoded with markings (e.g. lines) corresponding to locations along the scanning axis of sensor holder 132, with location sensor 210 being an optical sensor configured to optically read the markings. However, other implementations are possible, such as encoder strip 144 being magnetically encoded with location information and location sensor 210 being a magnetic reader, for example.

Figure 4:
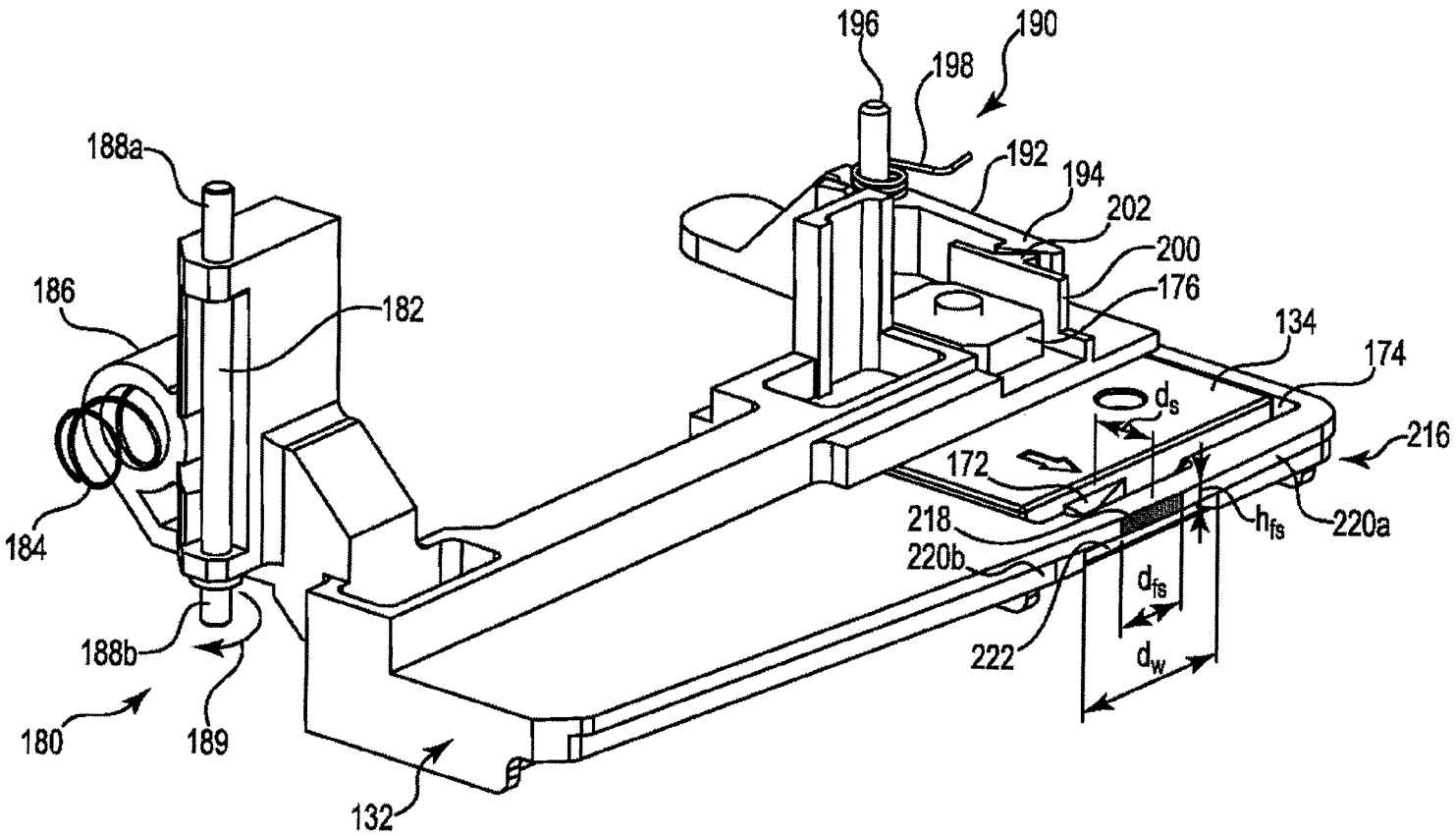
FIG. 4 is a perspective view illustrating one example of an optical sensor assembly.

FIG. 4 is a perspective view of portions of optical sensor assembly 130 which illustrates portions of sensor holder 132 in greater detail. A perimeter edge surface 216 of sensor holder 132, which is substantially parallel to optical window 172 of optical sensor 134, includes a following surface 218 having width, $d_{FS}$, and a height, $h_{FS}$, which is configured to contact the surface of print medium 116 when sensor holder 132 is in the deployed position (i.e. enabled to be biased against the surface of print medium 116). According to one embodiment, following surface 218 is a planar surface which is parallel to optical window 172 of optical sensor 134, with edge surface 216 including angled lead-in ramps 220*a*, 220*b* on each side of following surface such that edge surface 216 forms a "ski" with only following surface 218 contacting the surface of print medium 116. In other embodiments, following surface 218 may have other configurations. For example, according to one embodiment (not illustrated), edge surface 216 may be an arc shape, wherein following surface 218 is the portion of the arc in contact with the surface of print medium 116.

According to one embodiment, edge surface 216 includes a cutout or window 222 having a width, $d_W$, which parallels and spans the width, $d_{FS}$, of following surface 218 and also spans at least a width of optical window 172 of optical sensor 134. Window 222 enables light to be transmitted from and reflected light to be received by optical window 172 of optical sensor 134 when optical sensor assembly 130 is operating in a scanning or sensing mode.

As mentioned earlier, the position of optical sensor 134 can be adjusted within mounting channel 174 so that a distance, $d_S$, from optical window 172 to following surface 218 and, thus, to the surface of print medium 116, can be adjusted to a desired or selected distance. Different optical sensors 134 may have different distances, $d_S$, from the surface to be scanned at which the sensor provides optimal performance. Accordingly, the securing assembly 176 (e.g. nut/bolt) and mounting channel 174 enable the position of different sensors to adjusted so that the distance, $d_S$, can be selected so that optical window 172 at an optimal operating distance from the surface to be scanned.

Figure 5:
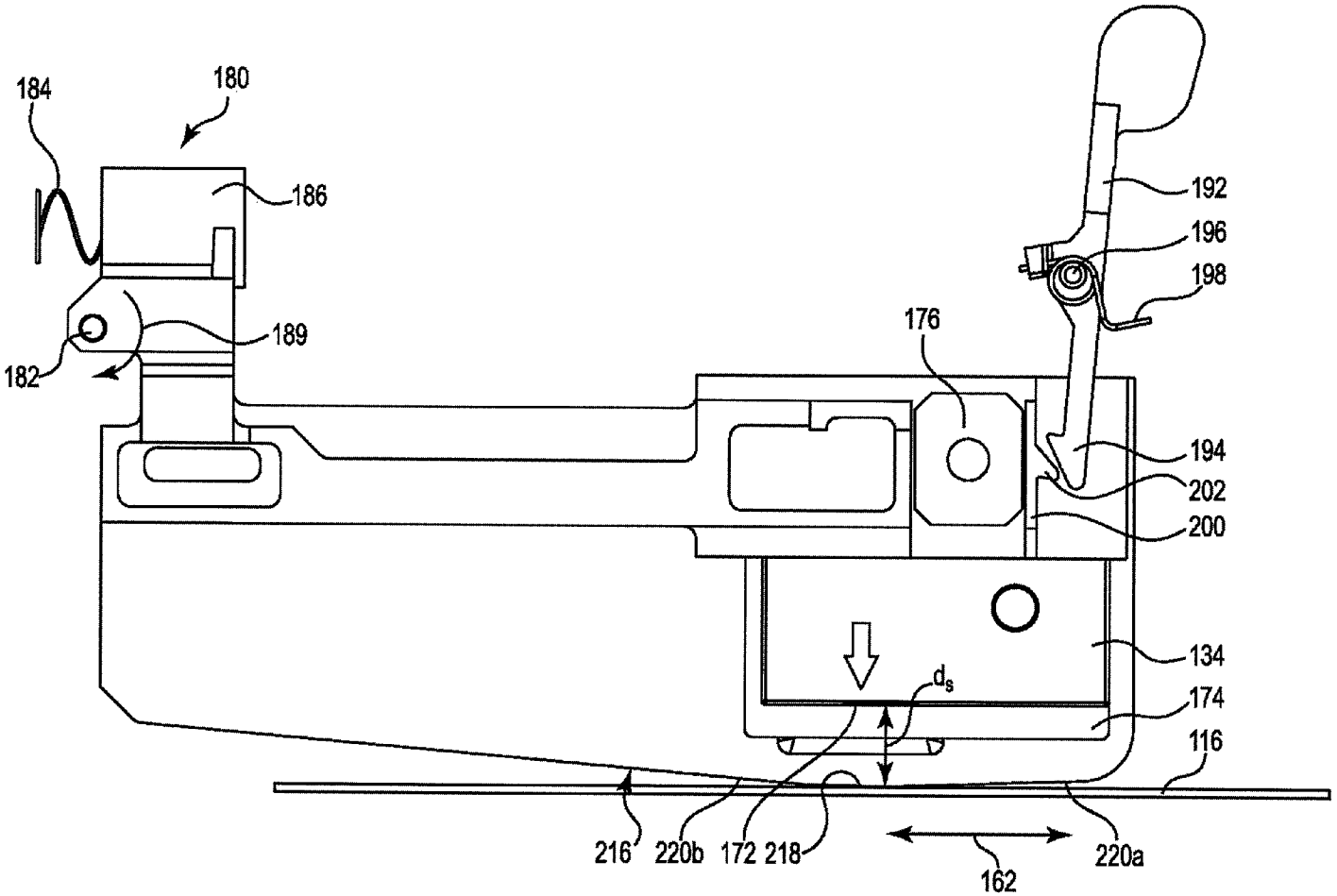
FIG. 5 is a top view illustrating one example of an optical sensor assembly.
Figure 6:
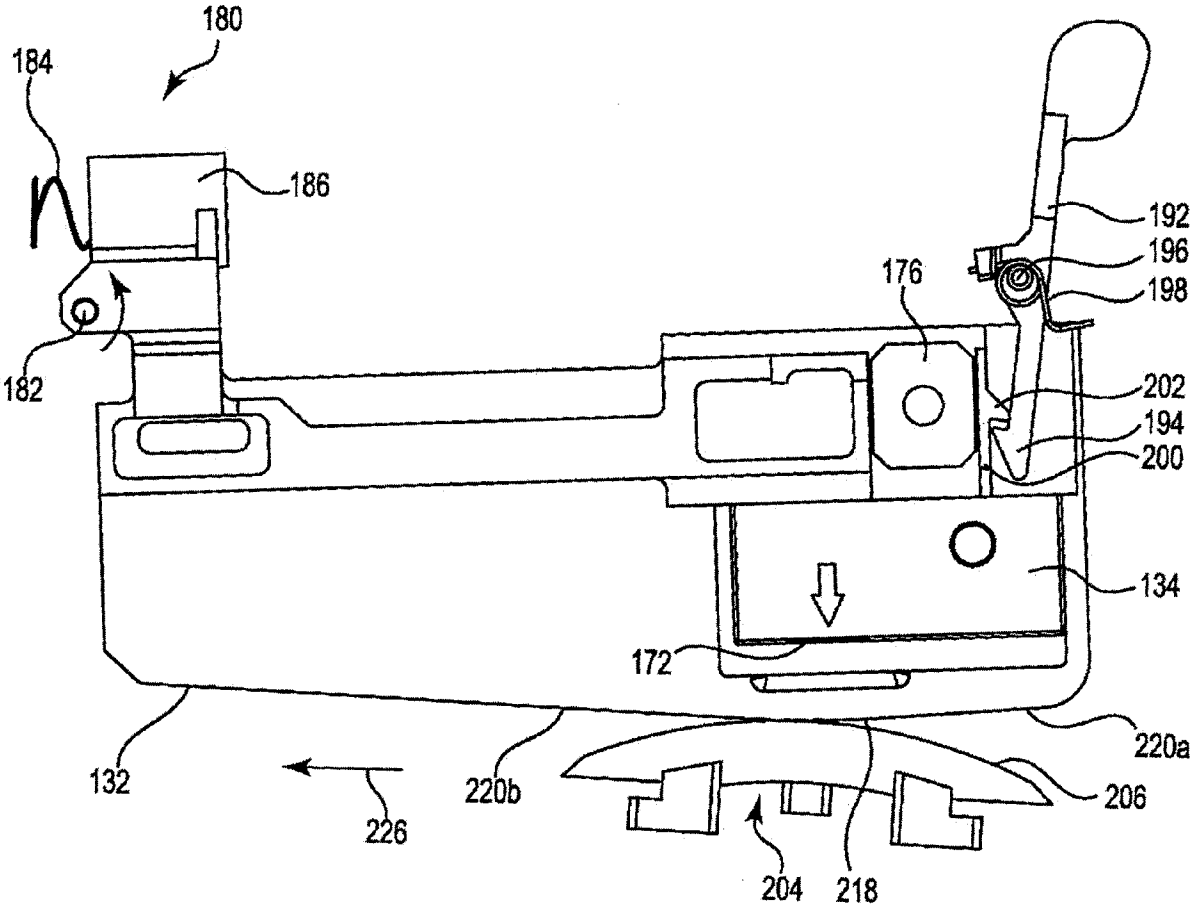
FIG. 6 is a top view illustrating one example of an optical sensor assembly.

As mentioned above, sensor holder 132 is moveable between a deployed position (where following surface 218 is biased against a surface of print medium 116) and a retracted position (where following surface is remote from and prevented from contacting a surface of print medium 116) by deployment system 190. FIGS. 4-6 represent top views of portions of optical sensor assembly 130, and illustrate the operation of deployment system 190 and the deployed and retracted positions of sensor holder 132.

FIG. 5 is a top view illustrating portions of optical sensor assembly 130 when sensor holder 132 is operating in a deployed position. In the deployed position, hook 194 of latch arm 192 of deployment system 190 is not engaged with notch element 202 of jam 200, such that the biasing force provided by spring 184 is free to rotate sensor holder 132 about pivot pin 182 in a clockwise direction 189 so that following surface 218 is biased against and follows the surface of print medium 116 as carriage 136 is driven back and forth along in scanning directions 162 along carriage rod 138.

By biasing following surface 218 against the surface of print medium 116 as is driven back and forth along carriage rod 138, optical sensor 134, and in particular optical window 172 of optical sensor 134, is maintained at the selected sensor distance $d_S$ from the surface of print medium 116. Lead-in ramps 220*a*, 220*b* of edge surface 216 of sensor holder 132 are angled away from the surface of print medium 116 so that following surface 218 is the only portion of edge surface 216 of sensor holder 132 in contact with the surface of print medium 116 and is better able to maintain continuous contact with the surface of print medium 116. Optimal angles for lead-in ramps 220*a*, 220*b* depend on the shape and size of ripples or bumps in print medium 116, wherein such bumps can vary depending on particular characteristics of different types of medium (e.g., velum, paper, cardstock, etc.).

For example, steeper angles are better suited for tall bumps that are close together, while shallower angles are better suited for shorter bumps that are spaced farther apart. As such, angles for lead-in ramps 220*a*, 220*b* for a particular sensor holder 132 may be optimized for the expected types of print medium 116 to be used. For example, in one embodiment, lead-in ramp 220*a* is at an angle of 2-degrees and lead-in ramp 220*b* is at an angle of 15-degrees. In one embodiment, the angles of lead-in ramps 220*a*, 220*b* are at angles within a range from 30 to 60 degrees.

In one embodiment, as mentioned above, in lieu of a planar following surface 218, following surface may have an arc shape (not illustrated) such that only that portion of the arc-shaped surface of following surface 218 that is substantially tangent to the surface of print medium 116 is in contact therewith. According to one embodiment, such are arc-shaped surface has a radius within a range from 1.5 mm to 3 mm. However, in other embodiments, radii of other dimensions can be employed, such as a 40 mm radius for example.

With additional reference to FIG. 4, following surface 218 has a width, $d_{FS}$, and a height, $h_{FS}$, which, similar to that of lead-in ramps 220*a*, 220*b*, have dimensions which may depend on the characteristics of bumps associated with different types of medium, where it is desired to have a width, $d_{FS}$, and a height, $h_{FS}$, which will not cause following surface 218 to ride up on and span across a distance between two adjacent bumps such that a gap is created between following surface 218 and a surface of print medium 216. According to one example, following surface 218 has a width, $d_{FS}$, of approximately 4.5 mm and a height, $h_{FS}$, of approximately 1 mm. However, other suitable dimensions may be employed.

Figure 8:
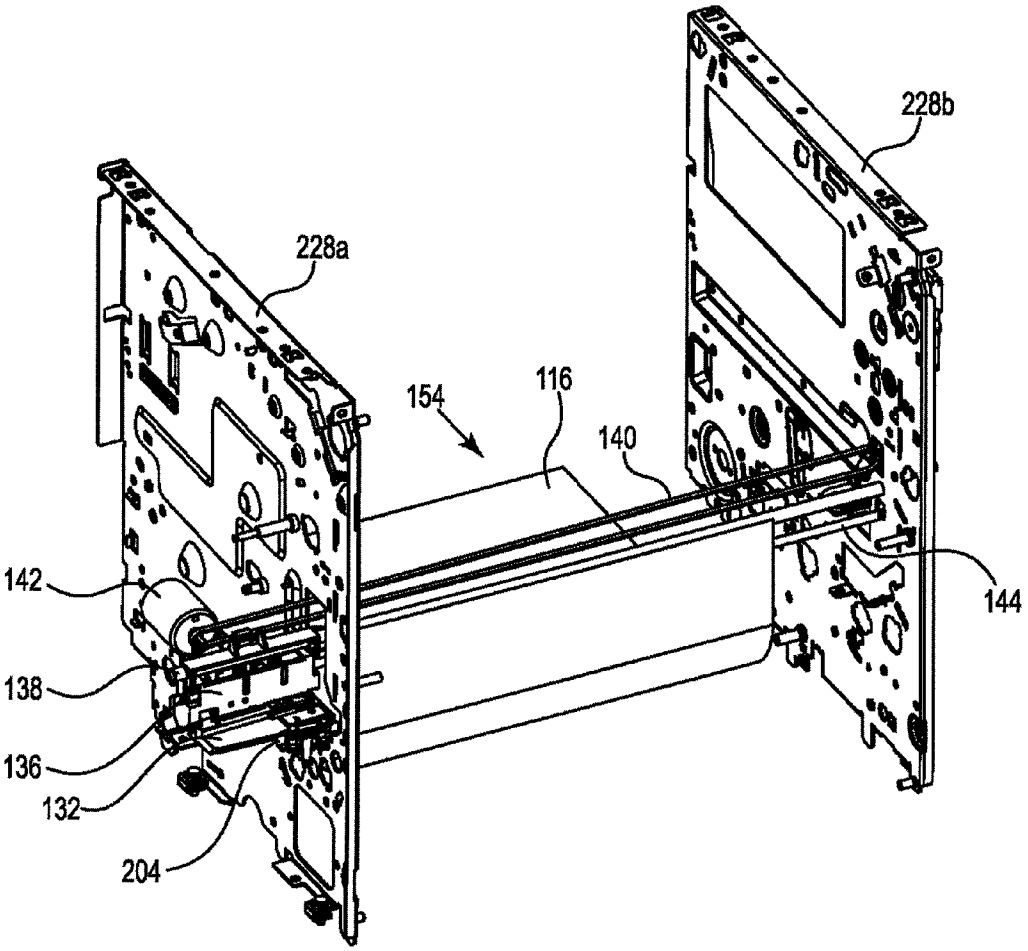
FIG. 8 is a perspective view illustrating portions of an inkjet printing system according to one example.

FIG. 6 is a top view illustrating portions of optical sensor assembly 130 when sensor holder 132 is transitioning from a deployed position to a retracted position. In FIG. 6, with further reference to FIG. 2 and FIG. 8, carriage 136 is being driven in a direction 226 to a "parked" position which is beyond the perimeter of a medium transport path on which medium, such as the sheet of print medium 116 is transported. With reference to FIG. 8, sensor holder 132 and carriage 136 are illustrated at a parked position which corresponds to the position illustrated by FIG. 6. In the "parked" position, sensor holder 132 and carriage 136 are positioned beyond the perimeter of a medium transport path along which print medium 116 is transported. According to one embodiment, as illustrated by FIG. 8, when in the "parked" position, sensor holder 132 and carriage 136 are positioned beyond a wall 228*a*, which, according to one example, forms a right-side of the medium transport path of inkjet printing system 100 when viewed from the front (as in FIG. 8), with opposing side wall 228*b* forming a left-side of the medium transport path.

As sensor holder 132 is moved in direction 226 (which is to the left in FIGS. 6 and 8), lead-in ramp 220*b* rides up on arc-shaped surface 206 of retraction ramp 204, which pushes sensor holder 132 away from retraction and causes notch 202 of jam 200 to slide past hook 194 of latch arm 192. The position illustrated in FIG. 6 is referred to as the "parked" position, where edge surface 216 of sensor holder 132 continues to rest on surface 206 of retraction ramp 204 with a small gap maintained between hook 194 and notch 202. It is noted that surface 206 of retraction ramp 204 is not limited to an arc-shape and that other suitable shapes can be employed to push sensor holder 132 to the parked position (e.g., a flat surface having lead-in ramps).

Figure 7:
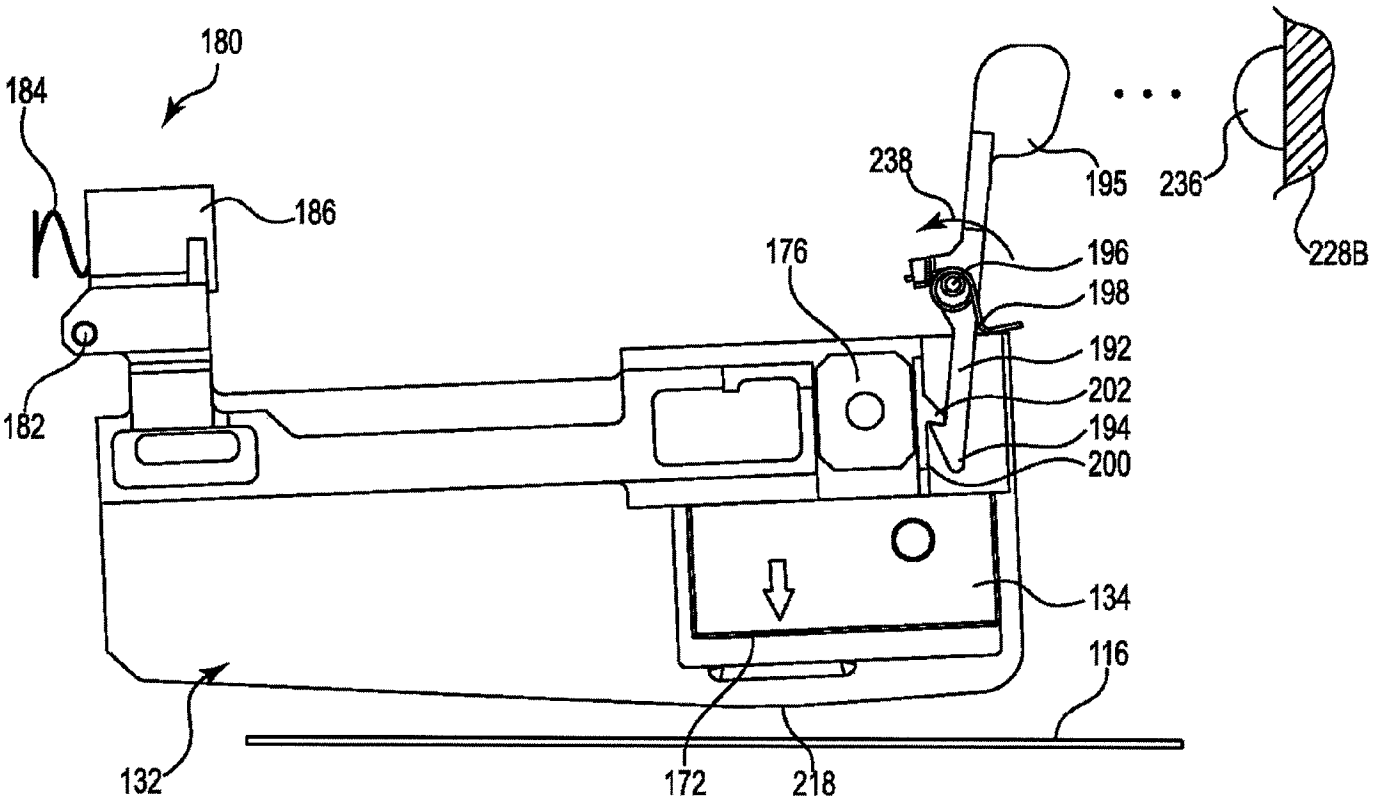
FIG. 7 is a top view illustrating one example of an optical sensor assembly.

FIG. 7 is a top view illustrating portions of optical sensor assembly 130 after sensor holder 132 has been moved from the "parked" position, as illustrated by FIG. 6, and is in the retracted position as it moves across the medium transport path above the surface of print medium 116. After leaving the "parked" position, sensor holder 132 no longer contacts retraction ramp 204 so that spring 184 is able to rotate sensor holder about pivot pin 182, as indicated by directional arrow 189, until notch 202 of jam 200 comes into contact with and is held by hook 194 of latch arm 192 so that following surface 218 is held away from the surface of print medium 116 as sensor holder 132 and carriage 136 are driven across the medium path in scanning directions 162.

According to one embodiment, to unlatch notch 202 from hook 192 and move sensor holder 132 to the deployed position, carriage 136 is driven along carriage rod 138 until an end 195 of latch arm 192 opposite hook 192 comes into contact with an unlatch element 236. Unlatch element 236 pushes latch arm 192 in a counter clockwise direction (in FIG. 7, as indicated by directional arrow 238) about pin 196 until hook 192 releases notch 202 so that the biasing force provided by spring 184 is able to rotate sensor holder 132 about pivot pin 182 until sensor holder 132 is in the deployed position with following surface 218 in contact with the surface of print medium 116, as illustrated by FIG. 5, or the lead-in ramp 220*b* is touching an edge of the print medium 116. According to one embodiment, unlatch element 236 is mounted on or is an integral part of a frame element of inkjet printing system 100, such as wall 228*b*, as illustrated by FIG. 8.

While the pivot pin 182 and spring 184 are effective at biasing the following surface 218 against the surface of print medium 116, rotation of sensor holder 132 about pivot pin 182 is circular in nature and may potentially result in following surface 218 not being exactly parallel with the surface of print medium 116. This can result in the optical window 172 being disposed at an angle relative to the surface of print medium 116, or the angle of optical window 172 relative to the surface of print medium 116 may change as sensor holder 132 rotates as following surface 218 rises or falls when following variations in the the surface of print medium 116 (and thereby light source and light sensor of optical sensor 134 being disposed at an angle to print medium 116), and potentially result in slight inaccuracies in measured optical densities.

Figure 9:
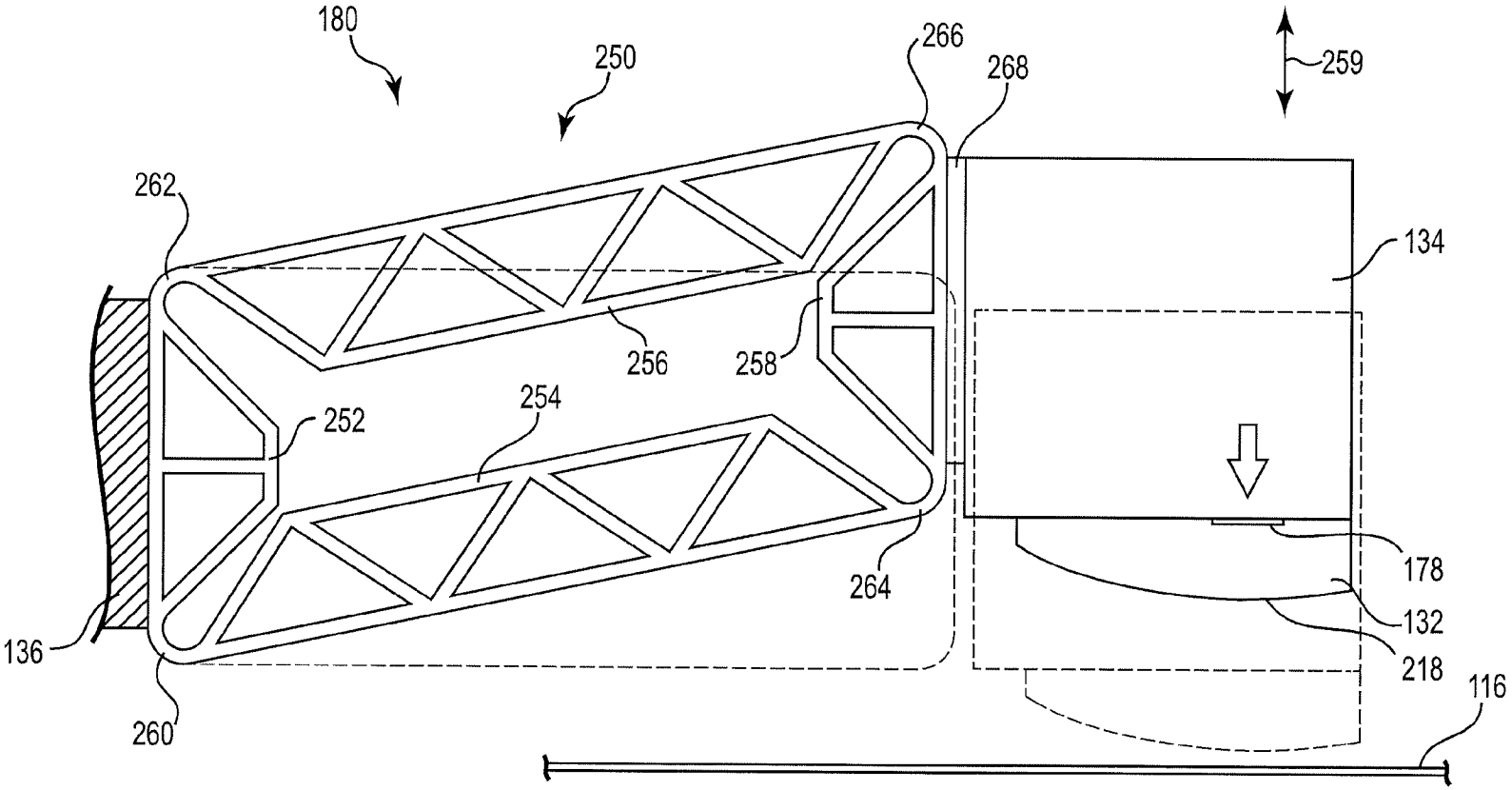
FIG. 9 is a top view illustrating one example of an optical sensor assembly.

FIG. 9 illustrates biasing assembly 180, according to one example, where a four-bar linkage 250 is employed in lieu of a pivot pin, wherein four-bar linkage 250 enables movement of sensor holder 132 and optical sensor 134 primarily in directions 259 which are substantially perpendicular to the surface of medium 116, so that optical window 172 is maintained substantially parallel to the surface of medium 116.

Four-bar linkage 250 includes a first link 252, a second link 254, a third link 256, and a fourth link 258. First link 252 is coupled to an element, such as a portion of carriage 136, and is a stationary link. Second and third links 254, 256 are rotating links which are pivotally coupled to first, or stationary, link 252 at pivots or hinges 260 and 262, respectively. Fourth link 256 is a coupling link to which second and third links 254, 256 are pivotally coupled at pivots or hinges 264 and 266, respectively. Fourth link 258 is further coupled, at 268 to sensor holder 132 and, thus, to sensor 134. According to one embodiment, as illustrated by FIG. 9, four-bar linkage 250 is formed from a single piece of material, such as a thermoplastic plastic (e.g. polyoxymethylene (acetal), Acrylonitrile butadiene styrene (ABS)), or other suitable material. In other embodiment, links 252-258 may be separate components joined at their ends by pins, for example.

Sensor holder 132, optical sensor 134, and four-bar linkage 250 are illustrated in the retracted position in FIG. 9, with the dashed lines indicating the position of four-bar linkage 250 and sensor holder 132/optical sensor 134 when in the deployed position with following surface 218 in contact with the surface of print medium 116. Not illustrated is a biasing mechanism or system which biases four-bar linkage 250 so as to be in the deployed position with the following surface 218 in contact with the surface of print medium 116. According to one embodiment, a spring is coupled to one or more of the linkages 256, 256, and 258 and biases the four-bar linkage 250 and sensor holder/optical sensor 134 in a direction toward print medium 116 so that following surface 218 is in contact with the surface thereof. According to one embodiment, a positioning system similar to deployment system 190 described above by FIG. 5-8 (e.g., latch arm 192, hook 194, notch 202, retraction ramp 204) employed to position four-bar linkage 250 and sensor holder 132/optical sensor 134 in a parked position, a deployed position, or a retracted position.

In operation, carriage 136 and sensor holder 132 are normally maintained in the "parked" position, as illustrated by FIGS. 7 and 8. Upon initiation of a sensing operation, such as by electronic controller 118, carriage 136 is moved from the parked position and driven to the far "right" of carriage rod 138, as illustrated in FIG. 8, until the end 195 of latch arm 192 contacts unlatch element 236. Carriage 136 is moved against unlatch element 236 until unlatch element 236 pushes latch arm 192 far enough in direction 238 (counter-clockwise in FIG. 7) about pin 196 until hook 194 releases notch 202, at which point spring 184 biases sensor holder 132 about pivot pin 182 and moves sensor holder 132 to the deployed position, where following surface 218 is biased against the sheet of print medium 116, as illustrated by FIG. 5.

Once in the deployed position, carriage 136 is driven or "scanned" across print medium 116 one or more times with following surface 188 sliding on the surface thereof so as to maintain optical sensor 134 at the selected distance $d_S$ (see FIG. 5) from the surface of print medium 116. As carriage 136 is driven across print medium 116, optical sensor 134 measures the optical density of printed ink on the surface of print medium 116 with the location of the optical density measurements being indexed to corresponding locations along the scan line based on the location information encoded on encoder strip 144.

According to one embodiment, the printed ink on print medium 116 being measured by optical sensor 134 is a test strip, such as test strip 164 (see FIG. 2) which is printed on print medium 116 by printhead dies 152 of print bar 150. According to one embodiment, the test strip 164 includes a series of gray scale sets, one gray scale set corresponding to each printhead die 152. It is noted that the test pattern may differ depending on the particular calibration process or the desired information needed (e.g., lines, bars, gray areas, etc.). Additionally, more than one test pattern may be printed on a single page.

As sensor holder 132 is scanned back and forth across test strip 164 with following surface 218 sliding along the surface of print medium 116, optical sensor 134 is maintained at the selected distance $d_S$ from the surface of print medium 116 and measures the optical densities of the gray scale set corresponding to each printhead die 152. The optical density measurements of the gray scale sets are indexed to each printhead 152 based on location information encoded in encoder strip 144. According to one embodiment, electronic controller 118 is configured to adjust one or more of printhead dies 152 based on the optical density measurements so that the optical density of printed ink by the plurality of printhead dies 152 is substantially uniform across the sheet of print medium 116. For example, electronic controller 118 may employ optical density information provided by optical sensor 134 to electronically compensate for firing energy and variations in drop volume that could produce visible print artifacts.

In addition to being employed to measure optical density of printed ink, optical sensor 134 may also be employed as a medium sensor to detect an edge of the sheet of print medium 116 or to measure die-to-die alignment errors as it moves along the transport path through print zone 112. When being employed to detect and edge of the sheet of print medium 116, carriage 136 can be moved along carriage rod 138 with sensor holder 132/optical sensor 134 being in the retracted position such that following surface 218 is remote from the surface of print medium 116, as illustrated by FIG. 7.

Figure 10:
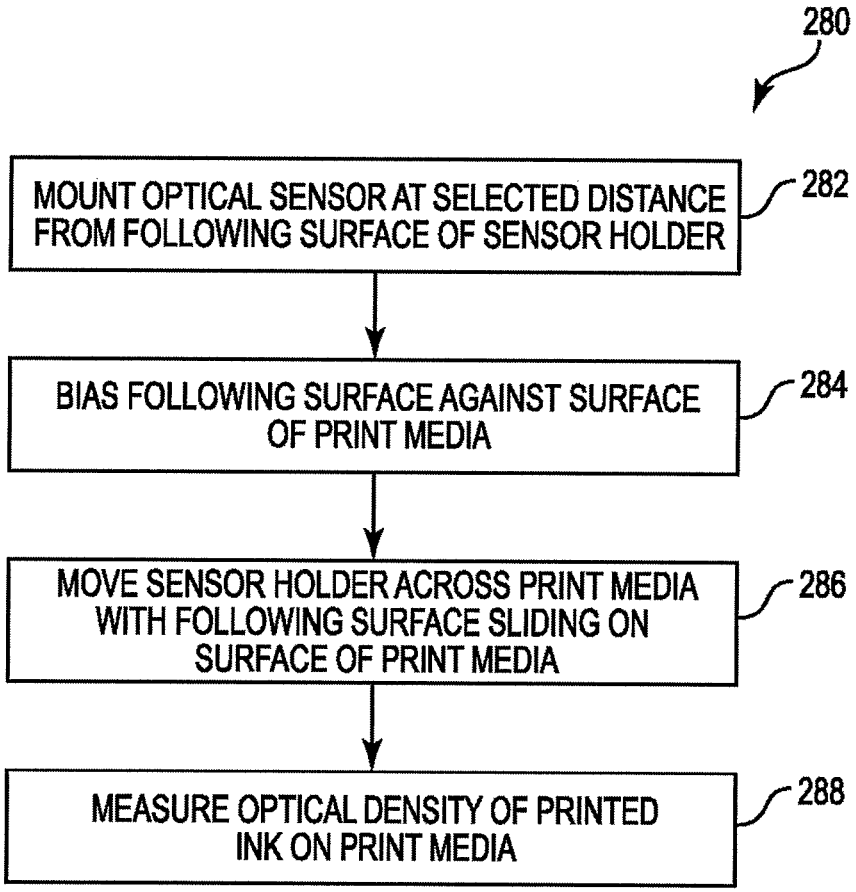
FIG. 10 is a flow diagram illustrating a method of operating an inkjet printer according to one embodiment.

FIG. 10 is a flow diagram 280 illustrating a method of operating an inkjet printer according to one example. At 282, an optical sensor is mounted on a moveable sensor holder so that an optical window of the optical sensor is at a selected distance from a following surface of the sensor holder.

At 284, the sensor hold is biased so that the following surface is held against a surface of a sheet of print medium. At 286, the method includes moving the sensor holder across the sheet of print medium with the following surface biased against and sliding on the surface of the sheet of print medium so that the optical window of the optical sensor is maintained at substantially the selected distance from the surface of the sheet of print medium. At 288, the method includes measuring the optical density of ink printed on the print medium with the optical sensor as it moves across the surface of the print medium.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A sensor positioning system comprising:

a moveable sensor holder having a following surface, the sensor holder configured to hold an optical sensor at a selected distance from the following surface;

a biasing system configured to bias the following surface against a surface of a sheet of print medium; and a drive system configured to move the sensor holder in reciprocating fashion across the sheet of print medium perpendicular to a direction of transport of the sheet of print medium with the following surface biased against and sliding on the surface of the sheet of print medium to maintain the optical sensor at substantially the selected distance from the surface of the sheet of print medium.

2. The sensor positioning system of claim 1, wherein the biasing system includes:

a pivot about which the sensor holder is configured to rotate, and a spring which provides a rotational force to the sensor holder about the pivot and biases the following surface against the surface of the print medium.

3. The sensor positioning system of claim 1, wherein the biasing system includes:

a four-bar linkage coupled to the sensor holder, the four-bar linkage enabling movement of the sensor holder only in directions substantially perpendicular to the surface of the sheet of print medium; and a biasing mechanism that biases the four-bar linkage toward the surface of the print medium such that the following surface of the sensor holder is biased against the surface of the print medium.

4. The sensor positioning system of claim 1, wherein the selected distance of the optical sensor from the following surface is adjustable.

5. The sensor positioning system of claim 1, wherein the following surface comprises a planar surface.

6. The sensor positioning system of claim 5, wherein the sensor holder includes lead-in ramps angled away from the surface of the print medium on each side of the following surface in scan directions of the sensor holder so that the lead-in ramps and following surface form a ski.

7. The sensor positioning system of claim 5, wherein the following surface has a length in directions of travel of the sensor holder that is less than minimum expected distances between apexes of successive bumps along a scan line of the sensor holder.

8. The sensor positioning system of claim 1, wherein the following surface comprises an arc-shaped surface, wherein a portion of the arc-shaped surface which is tangent to the surface of the print medium is biased against and slides along the surface of the print medium.

9. The sensor positioning system of claim 1, wherein the optical sensor comprises an optical density sensor that measures an optical density of ink printed on the print medium.

10. The sensor positioning system of claim 1, including a deployment system configured to move the sensor holder between a deployed position, where the following surface is biased against the surface of the print medium, and a retracted position, where the following surface is held away from contact with the surface of the print medium.

11. The sensor positioning system of claim 10, wherein the optical sensor is configured to detect at least one of an edge of a sheet of print medium and die-to-die alignment when the sensor holder is in the retracted position.

12. The sensor positioning system of claim 1, wherein the drive system includes:

a carriage rod extending orthogonally across a medium transport path along which the sheet of print medium travels;

a carriage slideably coupled to the carriage rod, the sensor holder coupled to the carriage;

an endless belt to which the carriage is coupled; and a motor which drives the endless belt to drive the carriage back and forth along a length of the carriage rod.

13. An inkjet printer comprising:

a printhead assembly having a plurality of stationary printhead dies arranged to form a page wide array; and a sensor assembly including:

a sensor holder having a following surface;

a biasing system configured to bias the following surface against the surface of the print medium;

an optical sensor having an optical window mounted to the sensor mount with the optical window at a selected distance from the following surface; and a drive system configured to drive the sensor holder across the print medium in a reciprocating fashion along a scan axis, where the following surface slides along the surface of the print medium and maintains the optical window substantially at the selected distance from the surface of the print medium.

14. The inkjet printer of claim 13, wherein the printhead assembly is configured to print a test strip on the sheet of print medium, the test strip having a portion corresponding to each printhead die, and wherein the optical sensor is configured to measure an optical density of each portion of the test strip as the drive system drives the sensor holder across the print medium.

15. The inkjet printer of claim 13, wherein the biasing system includes:

a pivot about which the sensor holder is configured to rotate, and a spring which provides a rotational force to the sensor holder about the pivot and biases the following surface against the surface of the print medium.

16. The inkjet printer of claim 13, wherein the biasing system includes:

a four-bar linkage coupled to the sensor holder, the four-bar linkage enabling movement of the sensor holder only in directions substantially perpendicular to the surface of the sheet of print medium; and a biasing mechanism that biases the four-bar linkage toward the surface of the print medium such that the following surface of the sensor holder is biased against the surface of the print medium.

17. The inkjet printer of claim 13, wherein the selected distance of the optical sensor from the following system is adjustable.

18. A method of positioning a sensor in an inkjet printer, the method comprising:

mounting an optical sensor on a moveable sensor holder so that an optical window of the optical sensor is at a selected distance from a following surface of the sensor holder;

biasing the sensor holder so that the following surface is held against a surface of a sheet of print medium; and moving the sensor holder across the sheet of print medium with the following surface biased against and sliding on the surface of the sheet of print medium to maintain the optical window of the optical sensor at substantially the selected distance from the surface of the sheet of print medium.

19. The method of claim 18, including measuring an optical density of ink printed on the surface of the sheet of print medium with the optical sensor as the sensor mount is moved across the sheet of print medium.

20. The method of claim 19, wherein the inkjet printer includes a plurality of printhead dies disposed across a medium transport path to form a print bar, the method including:

printing at least one test strip on the sheet of print medium with the print bar, the test strip including a different portion corresponding to each of the printhead dies;

measuring the optical density of the at least one test strip with the optical sensor as it is moved across the sheet of print medium; and adjusting the printhead dies based on the measured optical densities of the corresponding portions of the at least one test strip so that the optical densities of ink printed by each of the printhead dies is substantially uniform.

* * * * *